US010873816B2

(12) United States Patent
Feilner

(10) Patent No.: US 10,873,816 B2
(45) Date of Patent: Dec. 22, 2020

(54) PROVIDING FEEDBACK OF AN OWN VOICE LOUDNESS OF A USER OF A HEARING DEVICE

(71) Applicant: SONOVA AG, Staefa (CH)

(72) Inventor: Manuela Feilner, Egg bei Zürich (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/692,994

(22) Filed: Nov. 22, 2019

(65) Prior Publication Data

US 2020/0186943 A1 Jun. 11, 2020

(30) Foreign Application Priority Data

Dec. 5, 2018 (EP) ..... 18210505

(51) Int. Cl.
*H04R 25/00* (2006.01)
*G10L 25/51* (2013.01)

(52) U.S. Cl.
CPC ..... *H04R 25/305* (2013.01); *G10L 25/51* (2013.01); *H04R 2225/39* (2013.01); *H04R 2225/41* (2013.01)

(58) Field of Classification Search
CPC ..... H04R 25/00
USPC ..... 381/60
See application file for complete search history.

(56) References Cited

U.S. PATENT DOCUMENTS

| | | | | |
|---|---|---|---|---|
| 5,426,179 | A | 6/1995 | Bertolini | |
| 6,275,806 | B1 | 8/2001 | Pertrushin | |
| 7,222,075 | B2 | 5/2007 | Petrushin | |
| 7,627,475 | B2 | 12/2009 | Petrushin | |
| 7,940,914 | B2 | 5/2011 | Petrushin | |
| 8,965,770 | B2 | 2/2015 | Petrushin | |
| 9,973,861 | B2 | 5/2018 | Rosenkranz | |
| 2002/0194002 | A1 | 12/2002 | Petrushin | |
| 2003/0033145 | A1 | 2/2003 | Petrushin | |
| 2006/0183964 | A1* | 8/2006 | Kehoe | G09B 21/00 600/23 |
| 2007/0036365 | A1* | 2/2007 | Rohrseitz | H04R 25/70 381/60 |
| 2007/0162283 | A1 | 7/2007 | Petrushin | |
| 2009/0010456 | A1 | 1/2009 | Goldstein | |
| 2011/0178803 | A1 | 7/2011 | Petrushin | |
| 2014/0126735 | A1 | 5/2014 | Gauger, Jr. | |

(Continued)

FOREIGN PATENT DOCUMENTS

| | | |
|---|---|---|
| AU | 2015355097 | 6/2016 |
| CN | 107003997 | 8/2017 |

(Continued)

*Primary Examiner* — Melur Ramakrishnaiah

(74) *Attorney, Agent, or Firm* — ALG Intellectual Property. LLC

(57) ABSTRACT

A method for providing feedback of an own voice loudness of a user of a hearing device comprises: extracting an own voice signal of the user from an audio signal acquired with a microphone of the hearing device; determining a sound level of the own voice signal from the audio signal; determining an acoustic situation of the user; determining at least one of a minimal threshold and a maximal threshold for the sound level of the own voice signal from the acoustic situation of the user; and notifying the user, when the sound level is at least one of lower than the minimal threshold and higher than the maximal threshold.

18 Claims, 3 Drawing Sheets

(56) References Cited

U.S. PATENT DOCUMENTS

| | | | | |
|---|---|---|---|---|
| 2015/0271608 | A1* | 9/2015 | Sabin | H04R 25/70 381/314 |
| 2015/0289065 | A1* | 10/2015 | Jensen | H04R 25/405 381/315 |
| 2015/0310878 | A1 | 10/2015 | Bronakowski | |
| 2016/0163332 | A1 | 6/2016 | Un | |
| 2018/0054683 | A1* | 2/2018 | Pedersen | G10L 21/0208 |
| 2019/0020957 | A1* | 1/2019 | Kamkar-Parsi | H04R 25/43 |
| 2019/0075406 | A1* | 3/2019 | Petersen | H04R 25/552 |

FOREIGN PATENT DOCUMENTS

| | | |
|---|---|---|
| DE | 202008012183 | 4/2009 |
| EP | 1222448 | 8/2000 |
| WO | 2001016570 | 3/2001 |
| WO | 2010019634 | 2/2010 |
| WO | 2016089929 | 6/2016 |

* cited by examiner

PROVIDING FEEDBACK OF AN OWN VOICE LOUDNESS OF A USER OF A HEARING DEVICE

RELATED APPLICATIONS

The present application claims priority to EP Patent Application No. 18210505.6, filed on Dec. 5, 2018, and entitled "PROVIDING FEEDBACK OF AN OWN VOICE LOUDNESS OF A USER OF A HEARING DEVICE," the contents of which are hereby incorporated by reference in their entirety.

BACKGROUND INFORMATION

Hearing devices are generally small and complex devices. Hearing devices can include a processor, microphone, speaker, memory, housing, and other electronical and mechanical components. Some example hearing devices are Behind-The-Ear (BTE), Receiver-In-Canal (RIC), In-The-Ear (ITE), Completely-In-Canal (CIC), and Invisible-In-The-Canal (IIC) devices. A user can prefer one of these hearing devices compared to another device based on hearing loss, aesthetic preferences, lifestyle needs, and budget.

Some users of hearing devices claim to have problems to estimate the loudness of their voice, which may cause discomfort. This estimation may be difficult, while using a remote microphone or any other streaming device, since the microphone input of the hearing device may be attenuated, while in a streaming operation mode.

Hearing impaired children also tend to raise the pitch of their voice, when getting nervous and/or doubt to be understood by peers.

US 2006 0 183 964 A1 proposes to monitor level, pitch and frequency shape of a voice and to provide a feedback thereon.

DE 20 2008 012 183 U1 proposes to use the microphone of a smartphone to analyze a voice.

BRIEF DESCRIPTION OF THE DRAWINGS

The reference symbols used in the drawings, and their meanings, are listed in summary form in the list of reference symbols. In principle, identical parts are provided with the same reference symbols in the figures.

DETAILED DESCRIPTION

Figure 1:
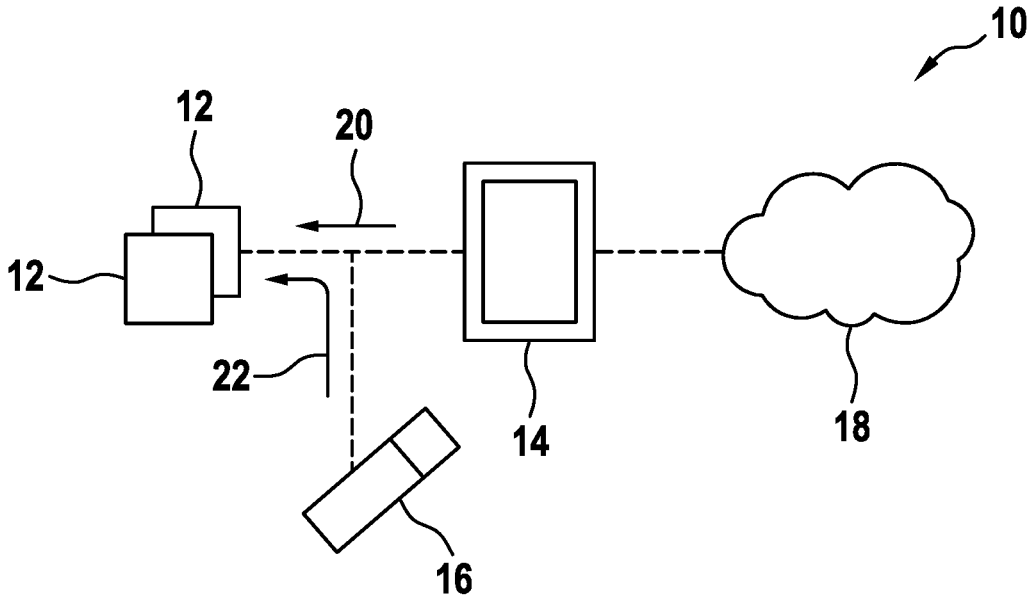
FIG. 1 schematically shows a hearing system according to an embodiment.

The embodiments described herein help a user of a hearing device in controlling his or her voice loudness.

This is achieved by the subject-matter of the independent claims. Further exemplary embodiments are evident from the dependent claims and the following description.

A first aspect described herein relates to a method for providing feedback of an own voice loudness of a user of a hearing device. The feedback may be any indication provided to the user that his or her voice is too silent or too loud. Such an indication may be provided to the user either directly via the hearing device, for example with a specific sound, and/or via a portable device, such as a smartphone, smartwatch, tablet computer, etc.

The hearing device may be a hearing aid adapted for compensating a hearing loss of the user. The hearing device may comprise a sound processor, such as a digital signal processor, which may attenuate and/or amplify a sound signal from one or more microphones, for example frequency and/or direction dependent, to compensate the hearing loss.

According to an embodiment, the method comprises: extracting an own voice signal of the user from an audio signal acquired with a microphone of the hearing device and determining a sound level of the own voice signal. For example, the hearing device may comprise at least two microphones and/or directional audio signals may be extracted from the audio signals of the microphones. Since a position and/or distance from the source of the own voice of the user and the hearing device is constant, an own voice signal may be extracted from the audio signal. The sound level of the own voice may be calculated from the own voice signal and/or may be provided in decibel.

It should be noted, that a microphone may be any sensor, which is adapted to transform vibrations to an electrical signal. Typically the microphone may be an electret condenser microphone, a MEMS-microphone or a dynamic microphone, it can however also be realized by an acceleration sensor or a strain gauge sensor. The microphone may pick up ambient sound. The microphone may pick up body vibrations, in particular vibrations of the skull or the throat of the user during speaking.

The own voice may be the voice of the user of the hearing device.

According to an embodiment, the method further comprises: determining an acoustic situation of the user. The acoustic situation may encode acoustic characteristics of the environment of the user. The actual acoustic situation may be a value and/or context data, which indicates an acoustical environment of the user. The sound situation may include numbers and/or distances of persons around the user, type and/or shape of the room, the user is in, the actual operation mode of the hearing device, etc. The acoustic situation may be automatically determined by the hearing device, for example from the audio signal of the microphone, further audio signals and/or audio stream received from another device and/or from context data, which, for example, may be provided by other devices, which may be in data communication with the hearing device.

According to an embodiment, the method further comprises: determining at least one of a minimal threshold and a maximal threshold for the sound level of the own voice signal from the acoustic situation of the user. Either from a table or with an algorithm, a range (or at least a lower bound or an upper bound of the range) is determined from the acoustic situation. For example, the range may be stored in a table and/or may be calculated from context data of the acoustic situation.

According to an embodiment, the method further comprises: notifying the user, when the sound level is at least one of lower than the minimal threshold and higher than the maximal threshold and notifying. When the sound level of his or her voice is outside of a desired range (or at least outside a lower bound or a higher bound of the range), the user may get feedback from the hearing device, that he is too loud or too silent. The user may get an indication, whether the loudness of his voice is adequate in a specific acoustic situation or not. The hearing device may give indication, whether the user shall raise his or her voice or lower the loudness.

Such an assistance of controlling the voice level of his or her voice may enhance a comfort of the user, for example while being involved in a discussion, while being streaming another sound signal, in a telephone conversation, etc.

Furthermore, a user may be trained with a new type of hearing device. Also, children may be trained learning to use their voice.

According to an embodiment, the at least one of the minimal threshold and the maximal threshold are determined from a table of thresholds, the table storing different thresholds for a plurality of acoustic situations. For every acoustic situation, the hearing device or a hearing system comprising the hearing device may determine an identifier for an acoustic situation and may determine the range and/or one bound of the range from a table by use of the identifier. For example, the hearing system may analyze context data, such as GPS data and/or and environment noise level. The context data and the associated own voice sound level range may be stored locally in a table.

The table may be multi-dimensional, depending on different variables. If the hearing system detects context data similar to context data stored in an entry of the table, the range and/or a bound of the range of this entry may be used.

According to an embodiment, the acoustic situation is determined from a further audio signal. The further audio signal may be extracted from the audio signal acquired by the hearing device. For example, an environmental noise level also may be extracted from the audio signal acquired by the microphone of the hearing device. It also may be that the further audio signal is acquired by a further microphone, such as a microphone carried by a further person and/or a stationary microphone in the environment of the user.

The hearing device may estimate a background noise and may calculate an optimal own voice loudness range therefrom. The hearing device may gather context data to estimate the distance of a listening person and may adapt the range accordingly. A further type of context data that may be extracted from the further audio signal may be a room acoustics, such as a reverberation time.

According to an embodiment, the acoustic situation is determined from a speech characteristics of another person. A own voice signal of another person may be extracted from an audio signal acquired by the hearing device and/or by a further microphone. From this own voice signal, the speech characteristics may be determined, such as a diffuseness of speech, an instantaneously diffuseness dependent on estimated room acoustics, a diffuseness dependent on room acoustics when background noise was low, level, a direction of arrival, which may be calculated binaurally, etc.

According to an embodiment, the acoustic situation is determined from a further user voice signal, which is extracted from the further audio signal. An own voice sound level of the user may be measured at a further person, who may be wearing a microphone as part of a communication system. The user also may put a further device with a microphone to a distant location within the room to retrieve feedback. Such a device may be any remote microphone.

According to an embodiment, determining the acoustic situation is based on an operation mode of the hearing device. In different operation modes, the own voice of the user may be differently attenuated and/or amplified. For example, this may be the case, when an audio signal and/or audio stream from another source as the microphone of the hearing device is output by the hearing device to the user. The operation mode may be streaming of a further audio source, such as from a remote microphone.

Also during a telephone call, the microphone of the hearing device may be damped. The operation mode may be a telephone call operation mode, where an audio signal and/or audio stream from a telephone call may be received in the hearing device and output by the hearing device to the user.

According to an embodiment, the method further comprises: determining the acoustic situation from a user input. It may be that the user provides input to a user interface, for example of a portable device. The user input may include at least one of a number of persons, to which the user is speaking and a distance to a person, to which the user is speaking.

According to an embodiment, the method further comprises: determining a location of the user. The location may be determined with a PGS sensor of the portable device and/or with other sender receivers, such as Bluetooth and/or WiFi sender/receivers, which also may be used for determining a location of the user and/or portable device relative to another sender/receiver. The acoustic situation then may be determined from the location of the user. For example, the location may be a restaurant, a train, a workplace, etc. and the acoustic situation may be set accordingly.

It also may be that a hearing system comprising the hearing receives information of locations of persons around the user, for example from GPS data acquired by their portable devices. A minimal and/or maximal threshold for the own voice sound level then may be determined based on these locations.

According to an embodiment, the minimal threshold and/or the maximal threshold for an acoustic situation are set by user input. The range may be manually set by the user with a portable device having a user interface. In an acoustic situation, the user may choose the range of own voice sound level himself, for example by defining the minimal threshold, which may indicate the minimal loudness the user wants to talk with. Additionally or alternatively, the user may define the maximal threshold, which may indicate the maximal loudness the user wants to talk. The range between the minimal threshold and the maximal threshold may represent the targeted loudness range of the user's voice. This range may be set situation dependent with a user interface on a smartphone and/or smartwatch.

It may be that the user gets feedback from a communication partner and enters the feedback to his hearing system by pressing a predefined button on the user interface, such as "ok", "too soft", "rather loud", etc.

It also may be that one or both of the thresholds are set by another person, such as a speech therapist.

According to an embodiment, the user is notified via an output device of the hearing device. The hearing device may have an output device, which may be adapted for notifying the user acoustically, tactilely (i.e. with vibrations) and/or visually. The output device of the hearing device may be the output device, which is used for outputting audio signals to the user, such as a loudspeaker or a cochlea implant.

According to an embodiment, the user is notified via a portable device carried by the user, which is in data communication with the hearing device. As already mentioned, such a device may be a smartphone and/or smartwatch, which may have actuators for acoustically, tactilely and/or visually notifying the user, such as a loudspeaker, a vibration device and/or a display.

For example, the notification may be provided by a vibrating smartwatch, smartphone, bracelet and/or other device.

A visual notification may be provided with a smartphone, which is blinking with a red screen. A visual notification also may be displayed in electronic eye-glasses. The sound level of the voice may be displayed in a graph on a smartphone in real time. It also may be that the sound level is displayed in a continuous way, by displaying the actual sound level and the thresholds.

It also may be that voice sound level of other persons are displayed, such as the sound level of a speech therapist.

According to an embodiment, the method further comprises: logging the sound level over time; and optionally visualizing a distribution of the sound level over time. The own voice sound level may be logged regularly and/or continuously. The user may have insight to a statistical distribution of his own voice sound level during specific time intervals, for example at the end of the day, at the end of the month, etc. A statistical distribution of the voice sound level during specific acoustic situations may be displayed.

Furthermore, the sound level evolving over time within a specific acoustic situation and/or over the whole day may be displayed. Also, the own voice sound level dependent on other parameters, such as a calendar entry, GPS location, acceleration sensors, day time, acoustic properties of the ambient signal, such as a background noise signal, signal-to-noise ratio, etc., may be displayed.

A speech pathologist and/or hearing care professional may have access to the logged data. Furthermore, instead of the own voice sound level, other speech parameters, such as described below, may be logged.

According to an embodiment, the method further comprises: monitoring other speech properties of the user. Not only the own voice sound level, but also other speech properties that may be extracted from the voice signal, such as a pitch of the voice, may be monitored. This may be done, like the own voice sound level is monitored as described above and below.

Such speech properties may include: a relative height of amplitudes in a 3 kHz range, breath control, articulation, speed of speaking, pauses, harrumphs, phrases, etc., emotional properties, excitement, anger, etc.

Further aspects described herein relate to a computer program for providing feedback of an own voice loudness of a user of a hearing device, which, when being executed by a processor, is adapted to carry out the steps of the method as described in the above and in the following as well as to a computer-readable medium, in which such a computer program is stored.

For example, the computer program may be executed in a processor of a hearing device, which hearing device, for example, may be carried by the person behind the ear. The computer-readable medium may be a memory of the hearing device. The computer program also may be executed by a processor of a portable device and the computer-readable medium at least partially may be a memory of the portable device. It also may be that steps of the method are performed by the hearing device and other steps of the method are performed by the portable device.

In general, a computer-readable medium may be a floppy disk, a hard disk, an USB (Universal Serial Bus) storage device, a RAM (Random Access Memory), a ROM (Read Only Memory), an EPROM (Erasable Programmable Read Only Memory) or a FLASH memory. A computer-readable medium may also be a data communication network, e.g. the Internet, which allows downloading a program code. The computer-readable medium may be a non-transitory or transitory medium.

A further aspect described herein relates to a hearing system comprising a hearing device, which is adapted for performing the method as described in the above and the below. The hearing system may further comprise a portable device and/or a portable microphone. For example, the notification of the user may be performed with the portable device, such as a smartphone, smartwatch, tablet computer, etc. With the portable microphone, a further audio signal may be generated, which may be additionally used for determining an actual acoustic situation.

It has to be understood that features of the method as described in the above and in the following may be features of the computer program, the computer-readable medium and the hearing system as described in the above and in the following, and vice versa.

These and other aspects described herein will be apparent from and elucidated with reference to the embodiments described hereinafter.

FIG. 1 shows a hearing system 10 comprising two hearing devices 12, a portable device 14 and an external microphone 16.

Each of the hearing devices 12 is adapted to be worn behind the ear and/or in the ear channel of a user. Also the portable device 14, which may be a smartphone, smartwatch or tablet computer, may be carried by the user. The portable device 14 may transmit data into and receive data from a data communication network 18, such as the Internet and/or a telephone communication network.

The hearing devices 12 may transmit data between them, for example for binaural audio processing and also may transmit data to the portable device 14. The hearing devices 12 also may receive data from the portable device 14, such as an audio signal 20, which may encode the audio signal of a telephone call received by the portable device 14.

The external microphone 16, which may be carried by a further person or may be placed in the environment of the user, also may generate an audio signal 22, which may be transmitted to the hearing devices 12. It has to be noted that audio streams, such as 20, 22, may be seen as digitized audio signals.

Figure 2:
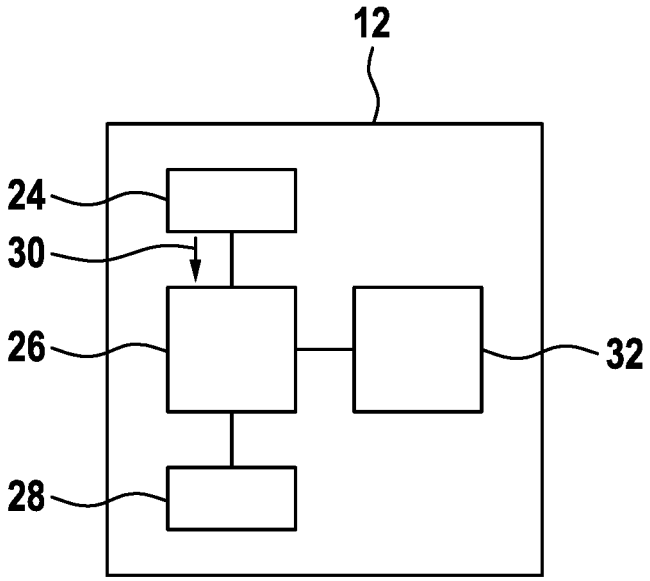
FIG. 2 schematically shows a hearing device for a hearing system according to an embodiment.

FIG. 2 shows a hearing device 12 in more detail. The hearing device 12 comprises an internal microphone 24, a processor 26 and an output device 28. An audio signal 30 may be generated by the microphone 24, which is processed by the processor 26, which may comprise a digital signal processor, and output by the output device 28, such as a loudspeaker and a cochlea implant.

The hearing device 12 furthermore comprises a sender/receiver 32, which for example via Bluetooth, may establish data communication with another hearing device 12 and/or which may receive the audio signals 20, 22. These audio signals 20, 22 may be processed by the processor 26 and/or may be output by the output device 28.

The external microphone may comprise also a sender/receiver for data communication with the hearing devices 12 and/or the portable device 14.

Figure 3:
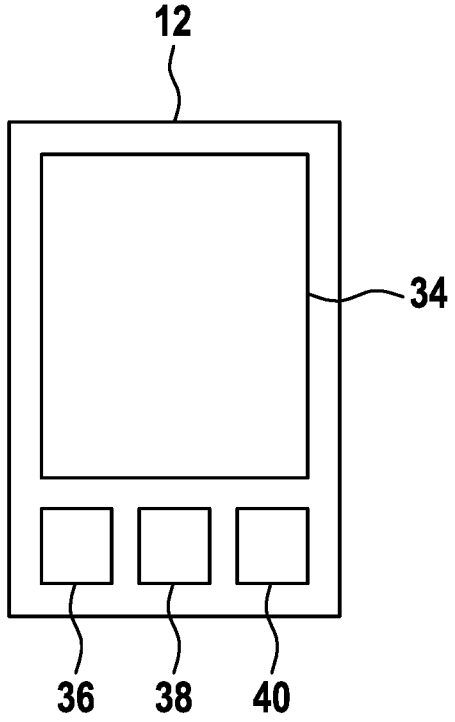
FIG. 3 schematically shows a portable device for a hearing system according to an embodiment.

FIG. 3 shows the portable device 14 in more detail. The portable device 14 may comprise a display 34, a sender/receiver 36, a loudspeaker 38 and/or a mechanical vibration generator 40. With the sender receiver 36, the portable device may establish data communication with the data communication network 18, for example via GSM, WiFi, etc., and the hearing devices 12. For example, a telephone call may be routed to the hearing devices 12.

Figure 4:
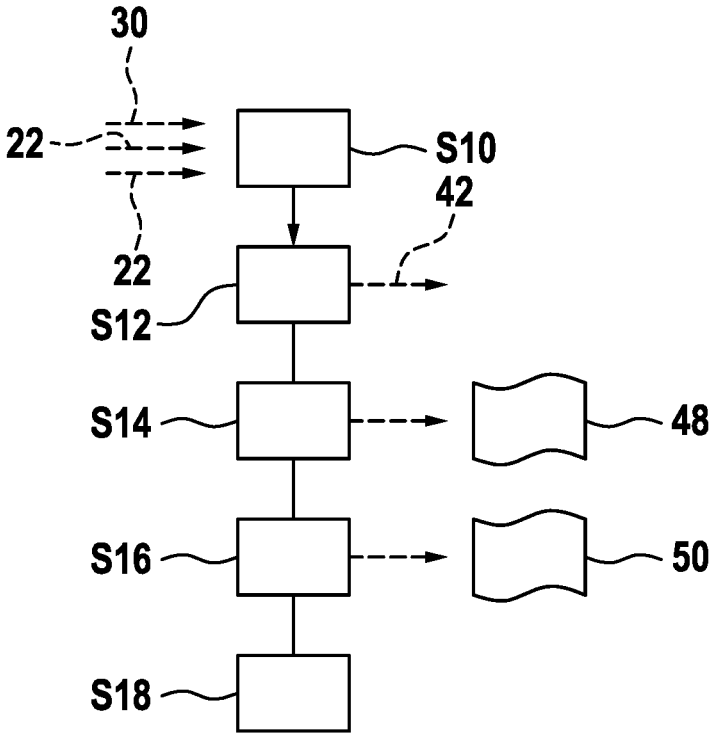
FIG. 4 shows a flow diagram for a method for providing feedback of an own voice loudness of a user of a hearing device according to an embodiment.

FIG. 4 shows a flow diagram for a method for providing feedback of an own voice loudness of a user of a hearing device 12. The method may be automatically performed by one or both hearing devices 12 optionally together with the portable device 14.

In step S10, the audio signal 30 is acquired by the hearing devices 12. The audio signal 30 may be processed with the processor 26, for example for compensating a hearing loss of the user, and output by the output device 28.

Furthermore, one or both of the audio signals 20, 22 may be received in the hearing devices 12. For example, the audio signal 20 may refer to a telephone call. The audio signal 22 may refer to a talk, which is given by a person speaking into the microphone 16. Also these audio signals 20, 22 may be processed with the processor 26, for example for compensating a hearing loss of the user, and output by the output device 28.

In step S12, an own voice signal 42 of the user is extracted from the audio signal 30 acquired with the microphone 24 of the hearing device 12 and a sound level 44 of the own voice signal 42 is determined. For example, the own voice signal 42 may be extracted from the audio signal with beamformers and/or filters implemented with the processor 26, which extract the parts of the audio signal 30, which are generated near to the hearing devices 12.

Figure 5:
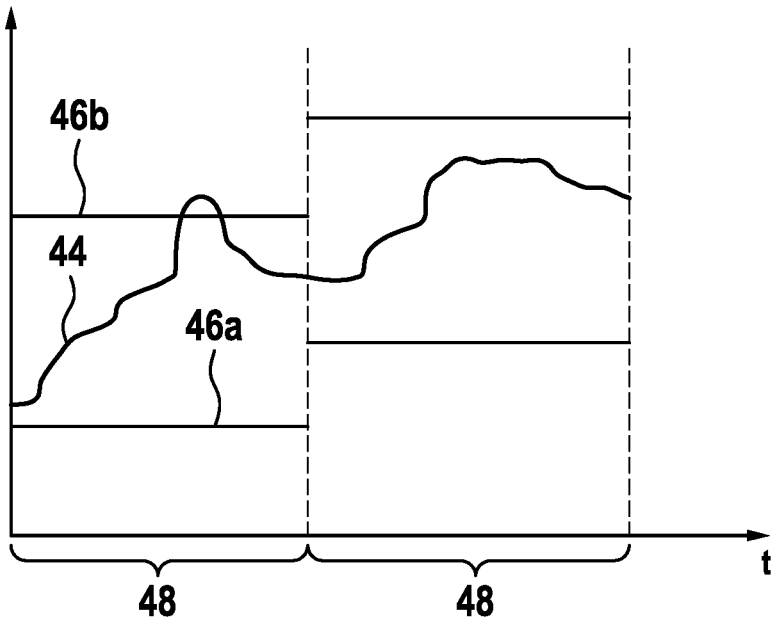
FIG. 5 shows a diagram illustrating quantities used in the method of FIG. 4.

FIG. 5 shows a diagram, in which the sound level 44 is shown over time. It can be seen that the sound level 44 may change over time.

Returning to FIG. 3, in step S14, an acoustic situation 48 of the user is determined by the hearing system.

In general, the acoustic situation 48 may be encoded in a value and/or in a context data structure, which indicates sound sources, persons and/or environmental conditions influencing, how the voice of the user can be heard by other persons. In one case, the acoustic situation may be a number. In another case, the acoustic situation may be a data structure comprising a plurality of parameters.

The acoustic situation may be determined from the audio signal 30, the audio signal 20 and/or the audio signal 22.

For example, a further audio signal 22 may be extracted from the audio signal 30 acquired by the hearing device 12. This further audio signal 22 may be a further voice signal, which may encode the voice of a person, who talks to the user. Also the audio signal 22 may contain a further voice signal, which may encode the voice of a person, who carries the microphone 16 and who talks to the user. From the sound level of the further voice signal, the distance of the other person may be determined.

Thus, the sound level of one or more other persons may be a part of the acoustic situation 48 and/or may have influence on the acoustic situation 48.

The acoustic situation 48 also may be determined and/or its context data may comprise a room acoustics and/or a speech characteristics of another person. Also, these quantities may be determined from one or more of the audio signals 30, 20, 22.

It also may be that the acoustic situation 48 is based on an operation mode of the hearing device 12, which operation mode may be a parameter influencing and/or being part of context data for the acoustic situation 48. For example, when the portable device 14 is streaming an audio signal 20, the hearing devices 12 may output this audio signal 20 in a specific operation mode.

As a further example, the acoustic situation 48 may be determined based on a user input. The user may input specific parameters into the portable device, which may become part of the context data and/or influence the acoustic situation 48. For example, the user input may include at least one of a number of persons, to which the user is speaking and/or a distance to a person, to which the user is speaking.

Also a location of the user, which may be determined with a GPS sensor of the portable device 14, may be part of the context data of the acoustic situation 48 and/or the acoustic situation 48 may be determined from the location of the user.

In step S14, at least one of a minimal threshold 46*a* and a maximal threshold 46*b* for the sound level 44 of the own voice signal 42 is determined from the acoustic situation 48 and/or from the context data of the acoustic situation 48.

FIG. 5 shows the thresholds 46*a*, 46*b* for two different acoustic situations 48. The acoustic situation 48 may change over time and the thresholds 46*a*, 46*b* may be adapted accordingly.

It may be that the thresholds 46*a*, 46*b* are determined with an algorithm from the acoustic situation 48 and/or from the context data of the acoustic situation 48. For example, it may be tried that the sound level 44 of the user is in a range within a sound level of another person and/or a noise sound level.

It also may be that a table of thresholds 46*a*, 46*b* is stored in the hearing devices 12 and/or the portable device 14. The table may comprise thresholds 46*a*, 46*b* for a plurality of acoustic situations 48. The records and/or entries of the table may be referenced with different acoustic situations 48 and/or their context data. The at least one of the minimal threshold 46*a* and the maximal threshold 46*b* may be determined from this table of thresholds.

When a specific acoustic situation has been identified it may be that the minimal threshold 46*a* and/or the maximal threshold 46*b* for the acoustic situation 48 may be set by a user input. For example, the user may change the thresholds 46*a*, 46*b* with a user interface of the portable device 14.

In step S16, it is determined, whether the sound level 44 is at least one of lower than the minimal threshold 46*a* and higher than the maximal threshold 46*b*, for example whether the sound level 44 is outside of the range defined by the two thresholds 46*a*, 46*b*.

When this is the case, the user receives a notification 50, which may be an acoustic, tactile and/or visual notification. For example, the user may be notified via the output device 28 of the hearing device 12, which may output a specific sound. The user also may be notified by the portable device 14, which may output specific sound with the loudspeaker, may vibrate with the vibration generator and/or may display an indicator for the sound level 44 on the display 34.

In step S18, the sound level 44 and/or further data, such as the acoustic situation 48 and/or the context data for the acoustic situation, may be logged over time. Later, the user and/or a voice trainer may look into the logged data, which may be visualized by the portable device 14 and/or other devices. For example, statistical distribution of the sound level 44, the acoustic situations 48 and/or the context data over time may be visualized.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practising the claimed invention, from a study of the drawings, the disclosure, and the appended claims. In the claims, the word "comprising" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SYMBOLS

10 hearing system
12 hearing device
14 portable device
16 external microphone
18 data communication network
20 audio stream
22 audio stream
24 internal microphone
26 processor
28 output device
30 audio signal
32 sender/receiver
34 display
36 sender/receiver
38 loudspeaker
40 vibration generator
42 own voice signal
44 sound level
46*a* minimal threshold
46*b* maximal threshold
48 acoustic situation
50 notification In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A method for providing notice to a user of a hearing device, the method comprising:
extracting an own voice signal of the user from an audio signal acquired with a microphone of the hearing device;
determining a sound level of the own voice signal;
determining, based on an operating mode of the hearing device, an acoustic situation of the user;
determining at least one of a minimum threshold and a maximum threshold for the sound level of the own voice signal from the acoustic situation of the user;
notifying the user, when the sound level is at least one of lower than the minimum threshold and higher than the maximum threshold.

2. The method of claim 1,
wherein the at least one of the minimal threshold and the maximal threshold are determined from a table of thresholds, the table storing different thresholds for a plurality of acoustic situations.

3. The method of claim 1,
wherein the acoustic situation is further determined from a further audio signal;
wherein the further audio signal is extracted from the audio signal acquired by the hearing device and/or the further audio signal is acquired by a further microphone.

4. The method of claim 1,
wherein the acoustic situation is further determined from at least one of:
a room acoustics;
a speech characteristics of another person;
a further user voice signal, which is extracted from a further audio signal.

5. The method of claim 1, wherein
determining the acoustic situation further depends on a user input.

6. The method of claim 5,
wherein the user input includes at least one of:
a number of persons, to which the user is speaking;
a distance to a person, to which the user is speaking.

7. The method of claim 1, further comprising:
determining a location of the user;
wherein determining the acoustic situation further depends on the location of the user.

8. The method of claim 1
wherein the minimal threshold and/or the maximal threshold for an acoustic situation are set by user input.

9. The method of claim 1,
wherein the user is notified via an output device of the hearing device; and/or
wherein the user is notified by a portable device carried by the user, which is in data communication with the hearing device.

10. The method of claim 9,
wherein the user is notified at least one of:
acoustically,
tactilely,
visually.

11. The method of claim 1, further comprising:
logging the sound level over time;
visualizing a distribution of the sound level over time.

12. A non-transitory computer-readable medium storing a computer program that, when executed, direct a processor to:
extract an own voice signal of a user from an audio signal acquired with a microphone of a hearing device;
determine a sound level of the own voice signal;
determine, based on an operating mode of the hearing device, an acoustic situation of the user;
determine at least one of a minimum threshold and a maximum threshold for the sound level of the own voice signal from the acoustic situation of the user;
notify the user, when the sound level is at least one of lower than the minimum threshold and higher than the maximum threshold.

13. A hearing system comprising:
a hearing device adapted to:
extract an own voice signal of a user from an audio signal acquired with a microphone of the hearing device;
determine a sound level of the own voice signal;
determine, based on an operating mode of the hearing device, an acoustic situation of the user;
determine at least one of a minimum threshold and a maximum threshold for the sound level of the own voice signal from the acoustic situation of the user;
notify the user, when the sound level is at least one of lower than the minimum threshold and higher than the maximum threshold.

14. The hearing system of claim 13, wherein the at least one of the minimal threshold and the maximal threshold are determined from a table of thresholds, the table storing different thresholds for a plurality of acoustic situations.

15. The hearing system of claim 13, wherein the acoustic situation is further determined from a further audio signal;

wherein the further audio signal is extracted from the audio signal acquired by the hearing device and/or the further audio signal is acquired by a further microphone.

16. The hearing system of claim 13, wherein the acoustic situation is further determined from at least one of:

a room acoustics;

a speech characteristics of another person;

a further user voice signal, which is extracted from a further audio signal.

17. The hearing system of claim 13, wherein determining the acoustic situation further depends on a user input.

18. The hearing system of claim 13, wherein the hearing device is further adapted to:

determine a location of the user;

wherein determining the acoustic situation further depends on the location of the user.

* * * * *